US008474999B2

(12) United States Patent
Ou et al.

(10) Patent No.: US 8,474,999 B2
(45) Date of Patent: Jul. 2, 2013

(54) LIGHT EMITTING DIODE LAMP

(75) Inventors: Chun-Heng Ou, New Taipei (TW); Yao-Sheng Liu, New Taipei (TW); Jia-Yi Juang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 99 days.

(21) Appl. No.: 13/180,562

(22) Filed: Jul. 12, 2011

(65) Prior Publication Data

US 2012/0281400 A1 Nov. 8, 2012

(30) Foreign Application Priority Data

May 3, 2011 (TW) ..... 100115474 A

(51) Int. Cl.
*F21V 21/00* (2006.01)

(52) U.S. Cl.
USPC ..... 362/249.02; 362/294; 362/373

(58) Field of Classification Search
USPC ..... 362/249.02, 294, 373, 545, 547; 313/498
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 7,866,850 | B2 * | 1/2011 | Alexander et al. | 362/294 |
| 7,972,054 | B2 * | 7/2011 | Alexander et al. | 362/652 |
| 8,125,776 | B2 * | 2/2012 | Alexander et al. | 361/688 |
| 2011/0063846 | A1 * | 3/2011 | Rizkin et al. | 362/260 |
| 2012/0218738 | A1 * | 8/2012 | Alexander et al. | 362/95 |

FOREIGN PATENT DOCUMENTS

| | | |
|---|---|---|
| TW | M350675 | 2/2009 |
| TW | M354038 | 4/2009 |
| TW | M364175 | 9/2009 |
| TW | M394427 | 12/2010 |

* cited by examiner

*Primary Examiner* — Ali Alavi
(74) *Attorney, Agent, or Firm* — Jainq Chyun IP Office

(57) ABSTRACT

A light emitting diode (LED) lamp includes a lamp holder, an optical module, a thermal pad, and a fixing ring. The lamp holder has a first recess in which the optical module is configured. The thermal pad is configured in the first recess and between the optical module and the lamp holder, so as to separate the optical module from the lamp holder. The fixing ring is locked to the lamp holder, so as to fix the optical module into the lamp holder. The optical module includes a first fixing element, an LED board, and a lens. The first fixing element has an accommodating opening in which the LED board is configured. The LED board includes a circuit board and LEDs, and the LEDs are configured on the circuit board. The lens is fixed to the first fixing element and covers the LEDs.

10 Claims, 5 Drawing Sheets

LIGHT EMITTING DIODE LAMP

CROSS-REFERENCE TO RELATED APPLICATION

This application claims the priority benefit of Taiwan application serial no. 100115474, filed on May 3, 2011. The entirety of the above-mentioned patent application is hereby incorporated by reference herein and made a part of this specification.

BACKGROUND OF THE INVENTION

1. Field of the Invention

The invention relates to a lamp. More particularly, the invention relates to a light emitting diode (LED) lamp capable of withstanding high voltages.

2. Description of the Related Art

An LED is a semiconductor element, and a material of a light emitting chip of the LED mainly includes a compound selected from group III-V chemical elements, such as gallium phosphide (GaP) or gallium arsenide (GaAs). The light emitting principle of the LED lies in the conversion of electric energy into optical energy. Specifically, after a current is applied to the compound semiconductor, the LED releases an excess of energy in a form of light through the combination of electrons and electron holes. Since the luminance of the LED does not result from heat emission or electric discharge, the life span of the LED can reach 100,000 hours or more. Moreover, the LED has the advantages of fast response speed, compact size, low power consumption, low pollution, high reliability, capability for mass production, etc. Therefore, the application of LED is fairly extensive. For instance, the LED can be applied to a mega-size outdoor display board, a traffic light, a mobile phone, a light source of a scanner and facsimile machine, an LED lamp, and so forth.

In the existing LED lamp design, a screw often passes through the LED board and is locked to the lamp holder. In consideration of structural strength and in compliance with safety standard, the screw is made of metal in most cases. The metal screw can pass the safety verification under the U.S. standard. Nonetheless, when the LED undergoes the voltage endurance inspection under the European standard, the high voltage at 4,000 volts is applied to the LED. Since the LED lamp is not equipped with a protection circuit, the LED is likely to be damaged by the high voltage.

SUMMARY OF THE INVENTION

The invention is directed to an LED lamp of which the design and the configuration allow the LED lamp to pass the voltage endurance inspection under the European standard even though the LED lamp does not have a protection circuit.

In an embodiment of the invention, an LED lamp that includes a lamp holder, an optical module, a thermal pad, and a fixing ring is provided. The lamp holder has a first recess in which the optical module is configured. The thermal pad is configured in the first recess and between the optical module and the lamp holder, so as to separate the optical module from the lamp holder. The fixing ring is locked to the lamp holder, so as to fix the optical module into the lamp holder. The optical module includes a first fixing element, an LED board, and a lens. The first fixing element has an accommodating opening in which the LED board is configured. The LED board includes a circuit board and a plurality of LEDs, and the LEDs are configured on the circuit board. The lens is fixed to the first fixing element and covers the LEDs.

According to an embodiment of the invention, the first fixing element has a plurality of first locking structures, and the first locking structures surround the accommodating opening.

According to an embodiment of the invention, the optical module further includes a second fixing element that is correspondingly locked into the first fixing element and configured on the LED board. The second fixing element has a plurality of second locking structures, and the second locking structures are locked to the first locking structures of the first fixing element.

According to an embodiment of the invention, when the first locking structures are locking hooks, the second locking structures are locking slots; when the first locking structures are locking slots, the second locking structures are locking hooks.

According to an embodiment of the invention, the second fixing element includes a bottom and a side wall. The bottom has a plurality of openings. The side wall surrounds the bottom, such that the side wall and the bottom together constitute a second recess. The LEDs correspondingly pass through the openings of the bottom and are located in the second recess, and the second locking structures are configured on the side wall.

According to an embodiment of the invention, the first fixing element further has a plurality of positioning columns, and the side wall of the second fixing element has a plurality of positioning openings. When the second fixing element leans against the first fixing element, the positioning columns are correspondingly located in the positioning openings.

According to an embodiment of the invention, a material of the second fixing element is a plastic material with high reflectivity.

According to an embodiment of the invention, the first fixing element has a ring shape, and a material of the first fixing element is an insulation material.

According to an embodiment of the invention, the lamp holder further has a plurality of fins, and the fins surround the first recess.

According to an embodiment of the invention, a material of the thermal pad is silicon rubber.

Based on the above, in the LED lamp described in the embodiments of the invention, the optical module and the lamp holder are separated from each other by the thermal pad for insulation and heat conduction. Besides, in the optical module, the LED board is fixed by the first and second fixing elements which are made of the insulation material. Hence, the LED lamp having said structure and the thermal pad can pass the voltage endurance inspection under the European standard.

Several exemplary embodiments accompanied with figures are described in detail below to further describe the disclosure in details.

BRIEF DESCRIPTION OF THE DRAWINGS

The accompanying drawings are included to provide a further understanding, and are incorporated in and constitute a part of this specification. The drawings illustrate embodiments and, together with the description, serve to explain the principles of the disclosure.

DESCRIPTION OF EMBODIMENTS

Figure 1:
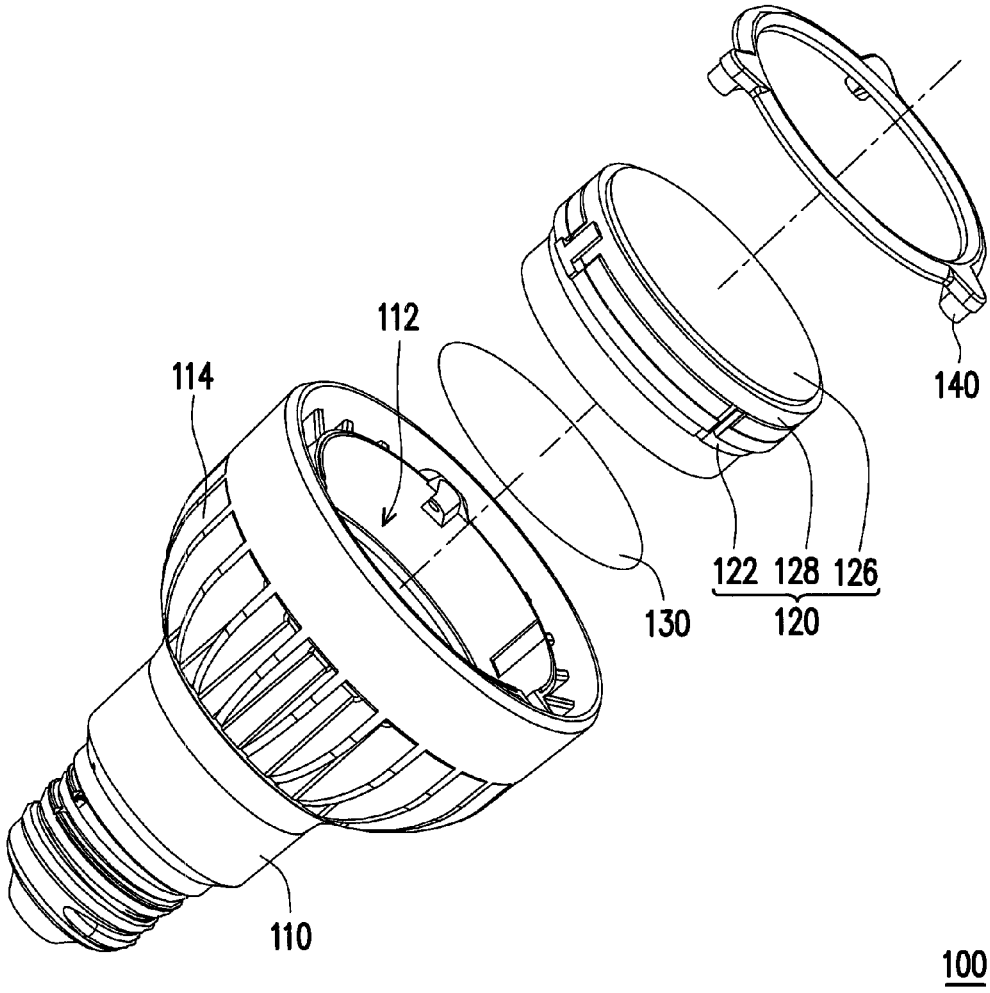
FIG. 1 is a schematic exploded view illustrating an LED lamp according to an embodiment of the invention.
Figure 2:
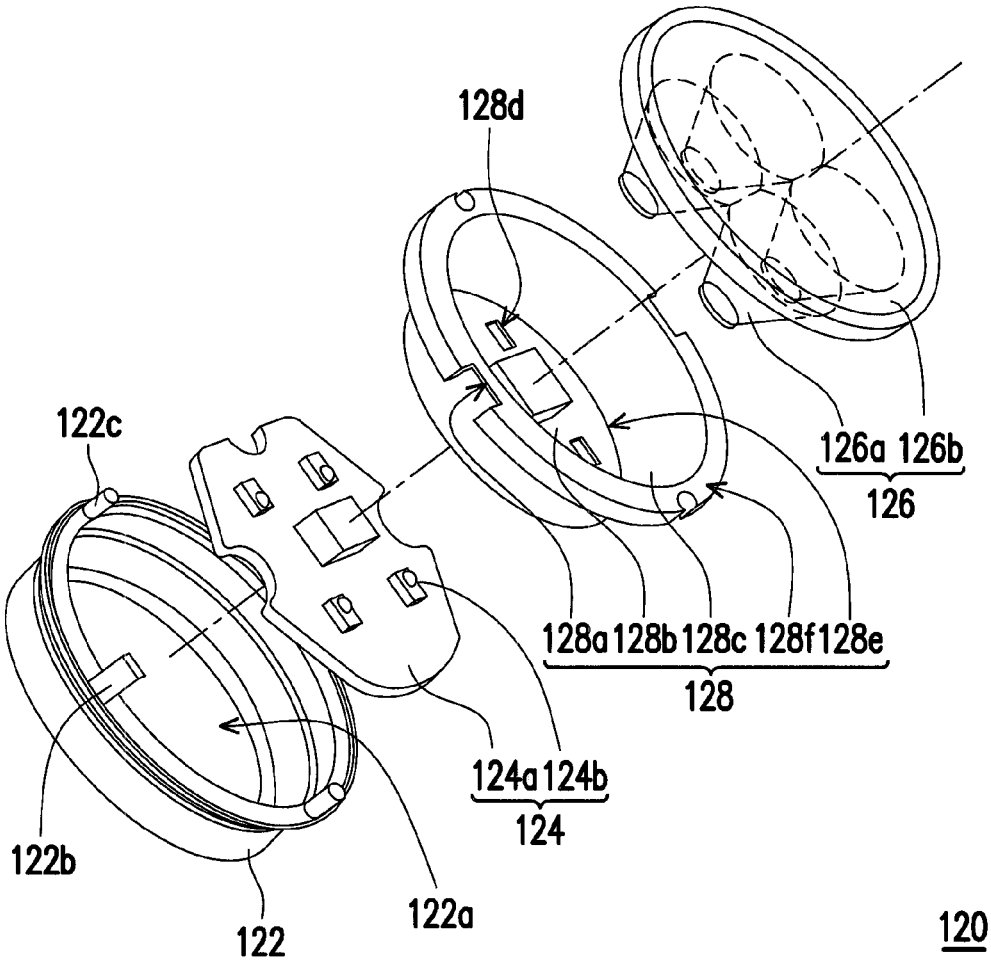
FIG. 2 is a schematic exploded view illustrating the optical module depicted in FIG. 1.
Figure 3:
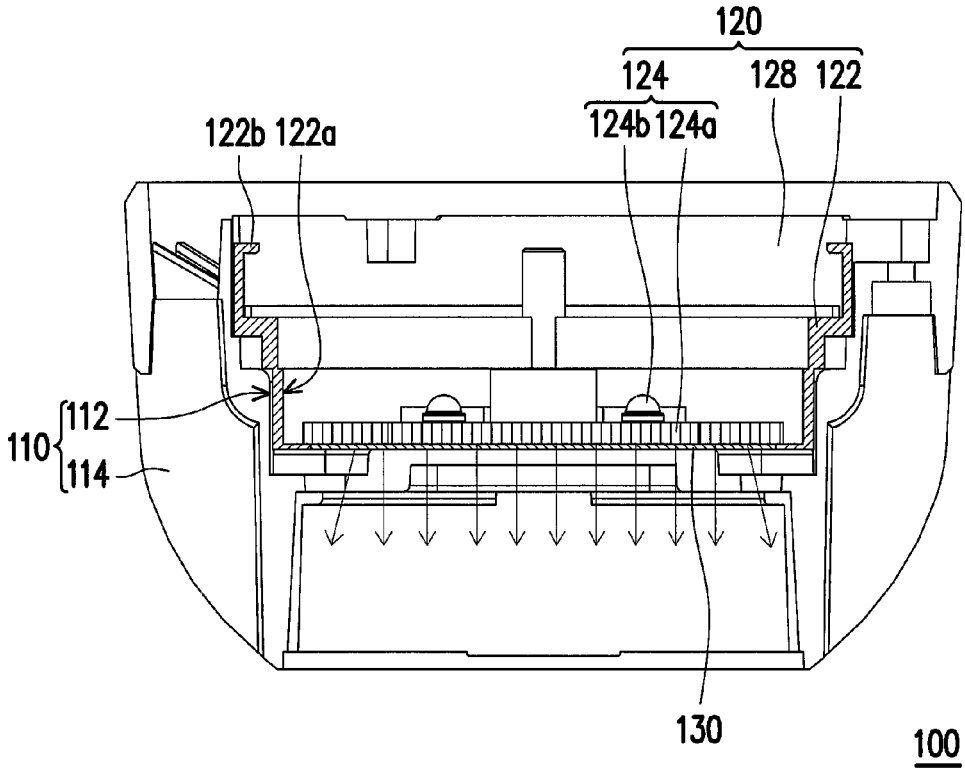
FIG. 3 is a partial cross-sectional view illustrating the LED lamp depicted in FIG. 1.

FIG. 1 is a schematic exploded view illustrating an LED lamp according to an embodiment of the invention. FIG. 2 is a schematic exploded view illustrating the optical module depicted in FIG. 1. FIG. 3 is a partial cross-sectional view illustrating the LED lamp depicted in FIG. 1. To simplify the illustration, the lens is omitted in FIG. 3. With reference to FIG. 1, FIG. 2, and FIG. 3, the LED lamp 100 of this embodiment includes a lamp holder 110, an optical module 120, a thermal pad 130, and a fixing ring 140. The lamp holder 110 has a first recess 112 in which the optical module 120 is configured. The thermal pad 130 is configured in the first recess 112 and between the optical module 120 and the lamp holder 110, so as to separate the optical module 120 from the lamp holder 110. Here, a material of the thermal pad 130 is silicon rubber, and thus the thermal pad 130 is characterized by insulation and heat dissipation capabilities. The fixing ring 140 is locked to the lamp holder 110, so as to fix the optical module 120 into the lamp holder 110. The optical module 120 includes a first fixing element 122, an LED board 124, and a lens 126. The first fixing element 122 has an accommodating opening 122*a* in which the LED board 124 is configured. The LED board 124 includes a circuit board 124*a* and a plurality of LEDs 124*b*, and the LEDs 124*b* are configured on the circuit board 124*a*. The lens 126 is fixed to the first fixing element 122 and covers the LEDs 124*b*. The thermal pad 130 can electrically insulate the LED board 124 from the lamp holder 110. The configuration of the first fixing element 122 and the thermal pad 130 is conducive to an increase in the distance between the LED board 124 and the lamp holder 110, and thereby the LED lamp 100 of this embodiment can pass the voltage endurance inspection under the European standard.

The first fixing element 122 has a ring shape, and the material of the first fixing element 122 is an insulation material. Besides, the first fixing element 122 further has a plurality of first locking structures 122*b* which surround the accommodating opening 122*a*. The optical module 120 further includes a second fixing element 128 that is correspondingly locked into the first fixing element 122. The second fixing element 128 is located on the LED board 124. The second fixing element 128 has a plurality of second locking structures 128*a*, and the second locking structures 128*a* are locked to the first locking structures 122*b* of the first fixing element 122. According to this embodiment, the first locking structures 122*b* are locking hooks, and the second locking structures 128*a* are locking slots. As long as the first locking structures 122*b* and the second locking structures 128*a* can be locked together, people having ordinary skill in the art are able to change the shapes or the types of the first locking structures 122*b* and the second locking structures 128*a* based on the actual requirements.

With reference to FIG. 1, FIG. 2, and FIG. 3, the second fixing element 128 includes a bottom 128*b* and a side wall 128*c*. The bottom 128*b* has a plurality of openings 128*d*. The side wall 128*c* surrounds the bottom 128*b*, such that the side wall 128*c* and the bottom 128*b* together constitute a second recess 128*e*. The LEDs 124*b* correspondingly pass through the openings 128*d* and are located in the second recess 128*e*. The second locking structures 128*a* are configured on the side wall 128*c*. When the second locking structures 128*a* are locked to the first locking structures 122*b*, the bottom 128*b* of the second fixing element 128 presses the circuit board 124*a* due to the locking force generated by the first and second locking structures 122*b* and 128*a*. Thereby, the circuit board 124*a* tightly leans against the thermal pad 130. It should be mentioned that the material of the second fixing element 128 is an insulation material as well, e.g., plastic. The upper and lower sides of the LED board 124 are respectively covered by the non-conductive thermal pad 130 and the insulated second fixing element 128, which ensures that the LED board 124 is insulated for protection. The material of the second fixing element 128 can also be a plastic material with high reflectivity. Thereby, the light emitted by the LEDs 124*b* can be effectively collected and reflected, so as to increase the entire brightness of the LED lamp 200 and raise the light utilization rate.

In order to improve alignment precision before assembly of the first and second fixing elements 122 and 128 and secure said assembly, the first fixing element 122 can further have a plurality of positioning columns 122*c*, and a plurality of positioning openings 128*f* can be correspondingly configured on the side wall 128*c* of the second fixing element 128. When the second fixing element 128 is to be locked to the first fixing element 122, the positioning openings 128*f* of the second fixing element 128 and, the positioning columns 122*c* of the first fixing element 122 are aligned, and the first and second fixing elements 122 and 128 are relatively moved to lock the first locking structures 122*b* to the second locking structures 128*a*. At this time, the positioning columns 122*c* are correspondingly located in the positioning openings 128*f*.

The lamp holder 110 can further have a plurality of fins 114 which surround the first recess 112. The configuration of fins 114 can enhance heat dissipation of the LED lamp 100 and ensure the brightness thereof. The lens 126 is configured in the second recess 128*e* of the second fixing element 128. Here, the lens 126 includes a cap 126*a* and a body 126*b*. The cap 126*a* is substantially in a corn shape and correspondingly covers the LEDs 124*b*. Note that the shape and the material of the cap 126*a* pose an impact on the light utilization rate of the LEDs 124*b*.

Figure 4:
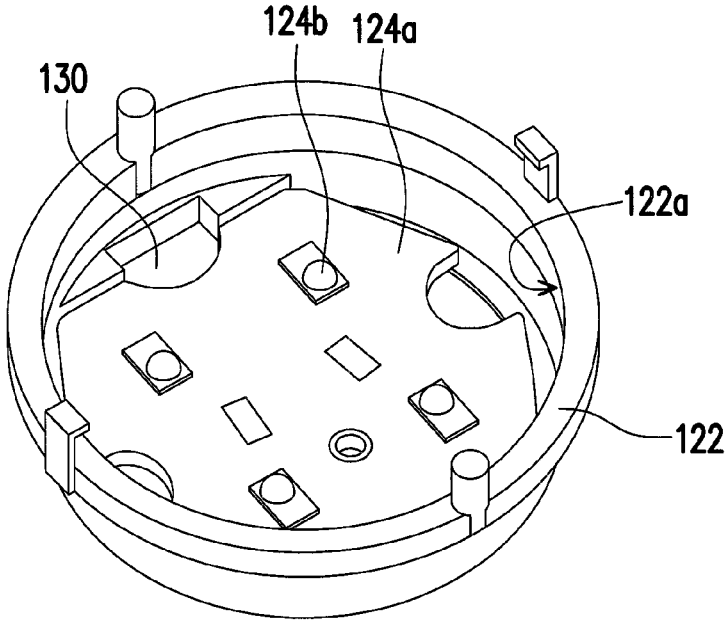
FIG. 4 is a schematic view illustrating the LED board in the first fixing element.
Figure 5:
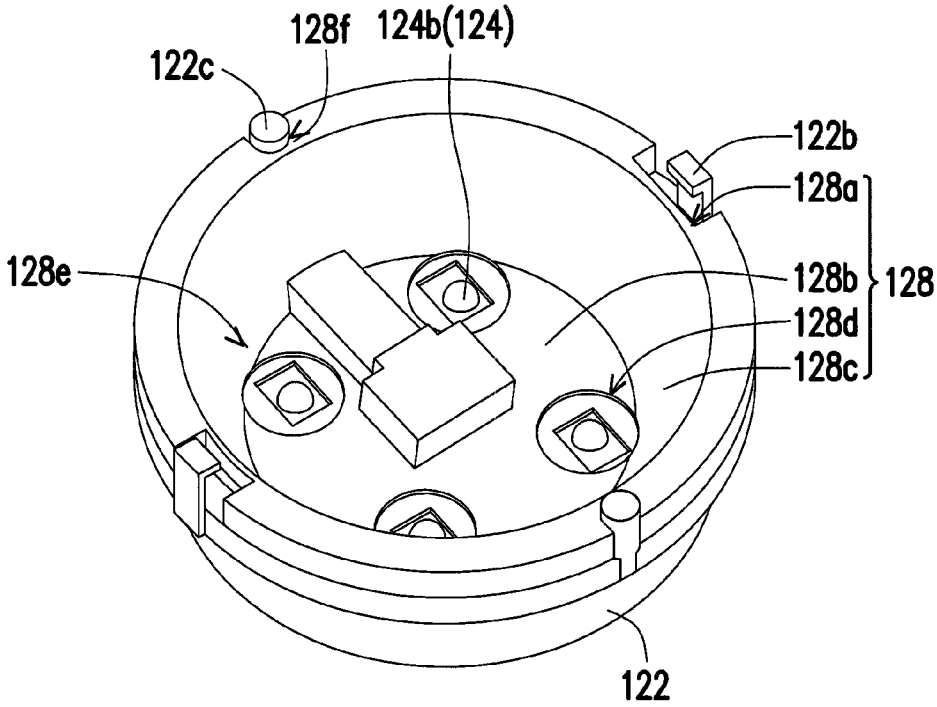
FIG. 5 is a schematic view illustrating that the first and second fixing elements are locked.
Figure 6:
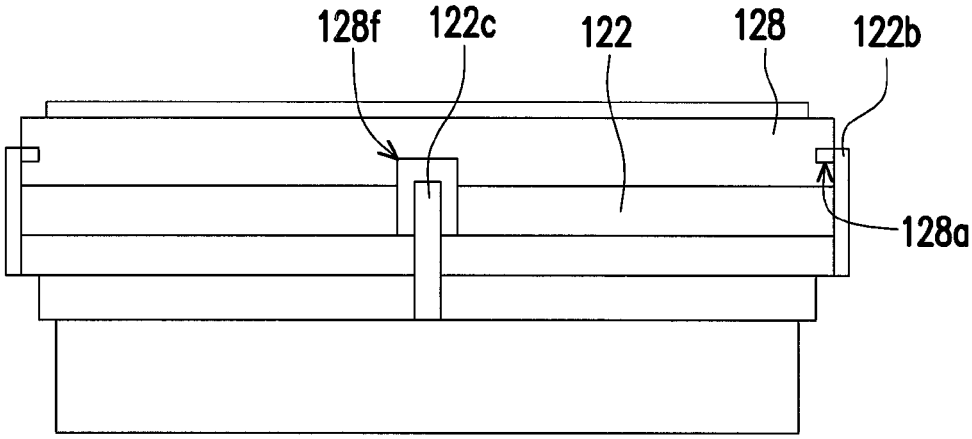
FIG. 6 is a side view illustrating that the first and second fixing elements depicted in FIG. 5 are locked.
Figure 7:
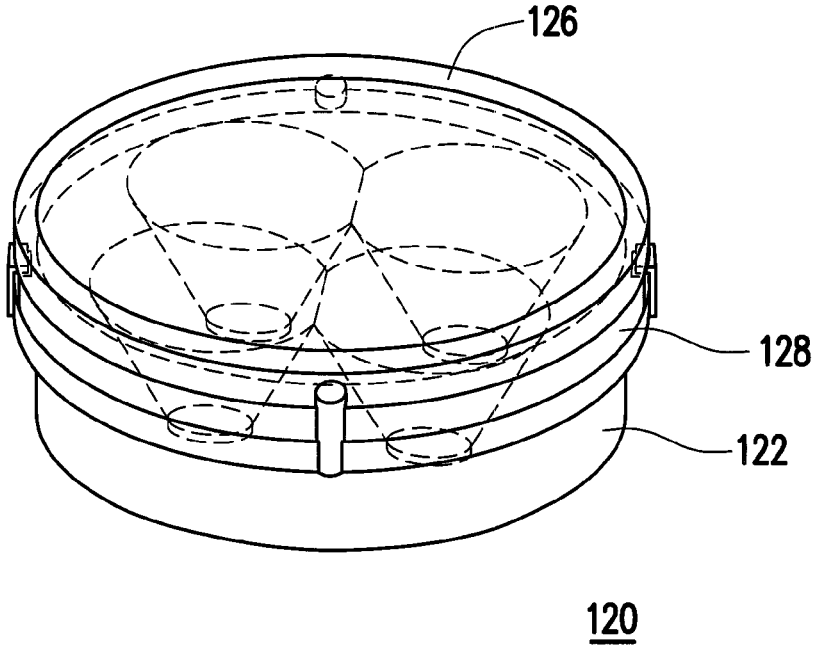
FIG. 7 is a schematic view illustrating that the optical module depicted in FIG. 2 is assembled.

FIG. 4 is a schematic view illustrating the LED board in the first fixing element. FIG. 5 is a schematic view illustrating that the first and second fixing elements are locked. With reference to FIG. 2, FIG. 4, and FIG. 5, in order to assemble the LED lamp 100 of this embodiment, the LED board 124 is placed in the accommodating opening 122*a* of the first fixing element 122, and the second fixing element 128 is placed on the LED board 124. The LEDs 124*b* correspondingly pass through the openings 128*d* of the second fixing element 128. FIG. 6 is a side view illustrating that the first and second fixing elements depicted in FIG. 5 are locked. As indicated in FIG. 6, the first locking structures 122*b* are locked to the walls of the second locking structures 128*a*, and the positioning columns 122*c* are correspondingly located in the positioning openings 128*f*. The lens 126 then covers the LED board 124 to form the optical module 120 shown in FIG. 7. Here, the cap 126*a* of the lens 126 correspondingly covers the LEDs 124*b*. With reference to FIG. 1 and FIG. 7, the optical module 120 is placed into the first recess 112 of the lamp holder 110, and the fixing ring 140 is locked to the lamp holder 110, so as to fix the optical module 120 into the lamp holder 110.

Note that the circuit board 124*a* is located between the thermal pad 130 and the bottom 128*b* of the second fixing element 128. In other words, the thermal pad 130 can be placed into the accommodating opening 122*a* of the first fixing element 122 before the LED board 124 is placed into the accommodating opening 122*a*. Alternatively, the thermal pad 130 can be placed into the first recess 112 of the lamp holder 110. That is to say, the thermal pad 130 is located between the lamp holder 110 and the optical module 120. Said two configurations of the thermal pad 130 both allow the circuit board 124*a* to be sandwiched in between the thermal pad 130 and the bottom 128*b* of the second fixing element 128.

With reference to FIG. 3, as described above, no screw is applied in the assembly process of the optical module 120 according to this embodiment. Even when the optical module 120 is assembled and fixed to the lamp holder 110, no screw is used. According to the related art, the conventional LED board is fixed to the lamp holder by the screws. By contrast, in this embodiment, when the LED lamp 100 described in this embodiment undergoes the voltage endurance inspection under the European standard, voltages are barely applied through the screws to the LED board 124, and thus the LEDs 124 are not damaged by high voltages. Besides, the thermal pad 130, the first fixing element 122, and the second fixing element 128 that are made of the insulation material together define a protection space to insulate the LED board 124 from the lamp holder 110 and increase the creepage distance. Hence, the LED lamp 100 can pass the voltage endurance inspection under the European standard. Since the thermal pad 130 is made of a thermal-conductive insulation material, when the LEDs 124 emit light, the heat generated by the LEDs 124 can be successfully transmitted to the lamp holder 110 through the thermal pad 130 and can then be dissipated. Namely, according to this embodiment, the issue of heat dissipation has been resolved.

In another embodiment that is not shown in the drawings, the lens 126 can be fixed to the first fixing element 122 through adhesion, in a tight-fit manner, or in other different ways. Thereby, the LED board 124 can be fixed into the accommodating opening 122*a* of the first fixing element 122 without employing the second fixing element 128.

To sum up, as described in the embodiments of the invention, two fixing elements that are made of the insulation material are applied instead of using the screw in the assembly process of the optical module in the LED lamp. Besides, the optical module is assembled to the lamp holder without using the screw. Hence, in the LED lamp having said structure and having the thermal pad that is made of the insulation material, the LED board can be insulated from the lamp holder and can be protected, so as to allow the LED lamp to pass the voltage endurance inspection. Additionally, by means of the components and the relative configuration thereof, the LED lamp can pass the voltage endurance inspection under the European standard. Hence, it is not necessary to design the protection circuit and configure the same in the LED lamp, and the labor time and costs can be effectively reduced. Moreover, the thermal pad is made of the thermal-conductive insulation material, and thus the thermal pad can transmit the heat generated by the LEDs to the lamp holder even though the LED board is insulated for protection. Namely, the LED lamp can accomplish the heat dissipation effect.

It will be apparent to those skilled in the art that various modifications and variations can be made to the structure of the disclosed embodiments without departing from the scope or spirit of the disclosure. In view of the foregoing, it is intended that the disclosure covers modifications and variations of this disclosure provided they fall within the scope of the following claims and their equivalents.

What is claimed is:

1. A light emitting diode lamp comprising:
a lamp holder having a first recess;
an optical module comprising:
a first fixing element having an accommodating opening;
a light emitting diode board configured in the accommodating opening, the light emitting diode board comprising a circuit board and a plurality of light emitting diodes, the light emitting diodes being configured on the circuit board;
a lens fixed to the first fixing element and covering the light emitting diodes;
a thermal pad configured between the light emitting diode board and the lamp holder to separate the light emitting diode board and the lamp holder; and
a fixing ring locked to the lamp holder to fix the optical module into the lamp holder, wherein no screw is applied in the light emitting diode lamp.

2. The light emitting diode lamp as recited in claim 1, wherein the first fixing element further has a plurality of first locking structures, and the first locking structures surround the accommodating opening.

3. The light emitting diode lamp as recited in claim 2, the optical module further comprising a second fixing element correspondingly locked into the first fixing element and configured on the light emitting diode board, the second fixing element having a plurality of second locking structures, the second locking structures being locked to the first locking structures of the first fixing element.

4. The light emitting diode lamp as recited in claim 3, wherein when the first locking structures are locking hooks, the second locking structures are locking slots, and when the first locking structures are locking slots, the second locking structures are locking hooks.

5. The light emitting diode lamp as recited in claim 3, wherein the second fixing element comprises:
a bottom having a plurality of openings; and
a side wall surrounding the bottom, the side wall and the bottom together constituting a second recess, the light emitting diodes correspondingly passing through the openings of the bottom and being located in the second recess, the second locking structures being configured on the side wall.

6. The light emitting diode lamp as recited in claim 5, wherein the first fixing element further has a plurality of positioning columns, the side wall of the second fixing element has a plurality of positioning openings, and the positioning columns are correspondingly located in the positioning openings when the second fixing element leans against the first fixing element.

7. The light emitting diode lamp as recited in claim 3, wherein a material of the second fixing element is a plastic material with high reflectivity.

8. The light emitting diode lamp as recited in claim 1, wherein the first fixing element has a ring shape, and a material of the first fixing element is an insulation material.

9. The light emitting diode lamp as recited in claim 1, wherein the lamp holder further has a plurality of fins, and the fins surround the first recess.

10. The light emitting diode lamp as recited in claim 1, wherein a material of the thermal pad is silicon rubber.

* * * * *